US005229191A

United States Patent [19]

Austin

[11] Patent Number: 5,229,191

[45] Date of Patent: Jul. 20, 1993

[54] COMPOSITE NONWOVEN FABRICS AND METHOD OF MAKING SAME

[75] Inventor: Jared A. Austin, Greer, S.C.

[73] Assignee: Fiberweb North America, Inc., Simpsonville, S.C.

[21] Appl. No.: 796,042

[22] Filed: Nov. 20, 1991

[51] Int. Cl.[5] ..... A61B 19/08; A61F 13/00; A61F 13/46; B32B 5/26; B32B 31/20

[52] U.S. Cl. ..... 428/198; 15/209.1; 128/849; 156/62.4; 156/62.6; 156/62.8; 156/167; 156/176; 156/290; 156/308.4; 428/286; 428/287; 428/296; 428/302; 604/366; 604/378

[58] Field of Search ..... 128/849; 428/198, 286, 428/287, 296, 302; 604/378, 366; 156/62.4, 62.6, 62.8, 167, 176, 290, 308.4

[56] References Cited

U.S. PATENT DOCUMENTS

| | | | |
|---|---|---|---|
| 4,196,245 | 4/1980 | Kitson et al. | 428/198 |
| 4,221,227 | 7/1980 | Anderson et al. | 128/296 |
| 4,287,251 | 9/1981 | King et al. | 428/198 |
| 4,310,594 | 1/1982 | Yamazaki et al. | 428/296 |
| 4,338,371 | 7/1982 | Dawn et al. | 428/283 |
| 4,355,066 | 10/1982 | Newman | 428/198 |
| 4,373,000 | 2/1983 | Knoke et al. | 428/198 |
| 4,436,780 | 3/1984 | Hotchkiss et al. | 428/198 |
| 4,511,615 | 4/1985 | Ohta | 428/198 |
| 4,537,822 | 8/1985 | Nanri et al. | 428/212 |
| 4,604,313 | 8/1986 | McFarland et al. | 428/286 |
| 4,652,484 | 3/1987 | Shiba et al. | 428/286 |
| 4,726,976 | 2/1988 | Karami et al. | 428/137 |
| 4,753,843 | 6/1988 | Cook et al. | 428/286 |
| 4,766,029 | 8/1988 | Brock et al. | 428/286 |
| 4,784,892 | 11/1988 | Storey et al. | 428/198 |
| 4,818,597 | 4/1989 | Da Ponte et al. | 428/286 |
| 4,837,078 | 6/1989 | Harrington | 428/284 |
| 4,885,204 | 12/1989 | Bither et al. | 428/284 |
| 4,904,521 | 2/1990 | Johnson et al. | 428/284 |
| 4,906,513 | 3/1990 | Kebbell et al. | 428/198 |

*Primary Examiner*—James C. Cannon

*Attorney, Agent, or Firm*—Bell, Seltzer, Park & Gibson

[57] ABSTRACT

The invention is directed to composite nonwoven fabrics comprising a hydrophobic nonwoven web, a nonwoven web of thermoplastic meltblown microfibers and a hydrophilic nonwoven web comprising staple fibers. The nonwoven web of thermoplastic meltblown fibers is sandwiched between the hydrophobic nonwoven web and the hydrophilic nonwoven web and all of the layers are thermally bonded together via discontinuous thermal bonds distributed substantially throughout the composite nonwoven fabric.

30 Claims, 2 Drawing Sheets

COMPOSITE NONWOVEN FABRICS AND METHOD OF MAKING SAME

FIELD OF THE INVENTION

The invention relates to nonwoven fabrics and to a process for producing nonwoven fabrics. More specifically, the invention relates to composite nonwoven fabrics having improved properties and to processes for producing the fabrics.

BACKGROUND OF THE INVENTION

Nonwoven webs are employed in a variety of products including personal care products such as diapers, disposable wipes, tissues, medical fabrics, clothing, and the like. Nonwoven webs which impede the passage of bacteria and other contaminants and have a desirable woven cloth-like hand are particularly desirable.

A barrier impervious to bacterial or other contaminants in a composite nonwoven fabric is often achieved by including a fibrous web, such as a meltblown web of microfine fibers, as a component of a nonwoven fabric. However, bonding such fibrous webs in a nonwoven fabric sufficiently to secure the fibrous layer can destroy or diminish the barrier properties of the fibrous web, particularly where the polymer compositions of the webs differ. Further, bonding such fibrous webs can also diminish fabric drapeability and air permeability. For example, as the percentage bonding area increases in thermal bonding techniques, typically the fabric becomes stiff and the passage of air through the fabric is restricted. Thus minimum bonding area is used in the construction of composite fabrics in an attempt to maintain the barrier properties and maximize fabric drapeability and air permeability of the nonwoven web in the composite.

Nonwoven fabrics having fluid repellent characteristics are particularly desirable for various uses, including use in the manufacture of surgical items such as surgical drapes and surgical gowns and as a component of a personal care fabrics. For example, it is often desirable to incorporate a hydrophobic nonwoven web as a liquid impermeable layer in a nonwoven composite to prevent fluids from penetrating the nonwoven fabric and reaching the wearer's skin. However, material used to manufacture such webs typically have a poor hand or feel, and thus such webs suffer from poor fabric aesthetics. Therefore, it would also be desirable to provide a comfortable texture and absorbency characteristic to a fluid repellent fabric, particularly for a side of a fabric adjacent to the wearer's skin.

U.S. Pat. No. 4,196,245 describes a composite nonwoven fabric which comprises at least two hydrophobic plies of microfine fibers and at least one nonwoven cover ply. The plies are bonded along the edges of the composite fabric to minimize bonding area, presumably to maximize barrier properties of the multiple interior plies. Additionally, multiple interior plies of meltblown webs are required to further provide barrier characteristics.

Others have taught other variations of nonwoven fabrics with various characteristics. U.S. Pat. No. 4,863,785 discloses a nonwoven continuously bonded trilaminate with areas of heavy, intermediate, and light bonding and comprising a meltblown fabric layer sandwiched between two pre-bonded, spunbonded reenforcing fabric layers. U.S. Pat. No. 4,726,976 discloses a nonwoven composite substrate having a fiber-film-fiber structure, the inner layer of which is melted in discrete areas to secure the layers to each other. While the patents disclose various embodiments of nonwoven fabrics, none of these patents disclose a composite nonwoven fabric that provides a barrier to the transmission of contaminants and repel fluids, and yet is also absorbent, has a cloth-like feel, is air permeable or breathable and is bonded to securely stabilize the barrier layer composite within the fabric without losing the benefit of barrier properties. Moreover, despite the widespread use of nonwoven fabrics, many commercially available fabrics still suffer from various shortcomings, such as the diminishment of barrier characteristics and undesirable hand and/or softness.

SUMMARY OF THE INVENTION

The invention provides composite nonwoven fabrics having desirable barrier properties, fluid repellency, absorbency and/or aesthetics in one fabric. The nonwoven fabric of the invention includes at least a hydrophobic nonwoven web, a nonwoven fibrous web of meltblown thermoplastic fibers, and a hydrophilic nonwoven web of staple fibers. The nonwoven meltblown fibrous web is sandwiched between the hydrophobic nonwoven web and the hydrophilic nonwoven web. All of the layers are thermally bonded together via discontinuous thermal bonds distributed substantially throughout the length and width dimensions of the composite nonwoven fabric. Even though the hydrophilic fibers are in contact with and bonded to the meltblown layer, the fabric maintains desirable barrier properties, such as fluid and bacteria barrier properties. Nevertheless, the fabric is not "clammy" on the hydrophilic side.

The hydrophobic nonwoven web used in laminates of the invention can be a spunbonded web of thermoplastic substantially continuous filaments. Alternatively, the hydrophobic nonwoven web can be a web of thermoplastic staple fibers. Advantageously, the hydrophobic nonwoven web is made from a thermoplastic polymer selected from the group consisting of polyolefins such as polypropylene and polyethylene, polyesters such as poly(ethylene terephthalate), polyamides such as poly(hexamethylene adipamide) and poly(caproamide), and blends and copolymers of these and other known fiber forming thermoplastic materials. Additionally, the hydrophobic nonwoven web can be prebonded before incorporation into the nonwoven composite of the invention.

The middle nonwoven fibrous web comprises a web of thermoplastic meltblown microfibers. The thermoplastic polymer used to form the meltblown layer can be any of various thermoplastic fiber forming materials known to the skilled artisan. Such materials include polyolefins such as polypropylene and polyethylene, polyesters such as poly(ethylene terephthalate), polyamides such as poly(hexamethylene adipamide) and poly(caproamide), polyacrylates such as poly(methylmethacrylate) and poly(ethylmethacrylate), polystyrene, thermoplastic elastomers, and blends of these and other known fiber forming thermoplastic materials.

The hydrophilic nonwoven web includes absorbent fibers in an amount sufficient to impart absorbency characteristics to the hydrophilic web, and can include both hydrophobic thermoplastic fibers and absorbent fibers The absorbent fibers preferably are fibers selected from the group consisting of cotton fibers, rayon fibers, wood fibers, and acrylic fibers. When used, thermoplastic fibers are advantageously fibers selected from the group consisting of polyolefins such as polypropylene and polyethylene, polyesters such as poly(ethylene terephthalate), polyamides such as poly(hexamethylene adipamide) and poly(caproamide), polyacrylates such as poly(methylmethacrylate) and poly(ethylmethacrylate), polystyrene, thermoplastic elastomers, and blends of these and other known fiber forming thermoplastic materials. The hydrophilic nonwoven web may be prebonded before its incorporation in the composite nonwoven fabric of the invention.

Nonwoven fabrics according to the invention can be readily manufactured according to another aspect of the invention. The nonwoven composite fabric may be manufactured by forming a layered web including a nonwoven web of thermoplastic meltblown microfibers sandwiched between a hydrophobic nonwoven web and a hydrophilic nonwoven web comprising staple fibers. Thereafter the layers of the resultant composite nonwoven fabric are subjected to a thermal bonding treatment sufficient to provide discontinuous thermal bonds distributed substantially throughout the surface of the composite nonwoven fabric. Advantageously, the composite fabric is bonded by means of an embossing calender.

The composite nonwoven fabrics of the invention provide several desirable and yet apparently opposing properties in one fabric. The fabrics of the invention not only provide both a barrier to the transmission of fluids, bacteria and other containments and fluid repellency; they also provide desirable aesthetics such as a cloth-like feel and absorbency without the diminishment of the barrier and fluid repellency characteristics.

BRIEF DESCRIPTION OF THE DRAWINGS

In the drawings which form a portion of the original disclosure of the invention.

DETAILED DESCRIPTION OF THE INVENTION

While not intended to be so limited, the composite nonwoven fabric of the present invention will be described in terms primarily of its application to surgical items, such as surgical gowns, surgical drapes and the like. The composite nonwoven fabrics of the invention are particularly useful in surgical applications, but are also useful for any other application wherein a barrier to contaminants and fluid repellency, as well as a cloth-like feel and absorbency, would be desirable, such as diapers and sanitary napkins.

Figure 1:
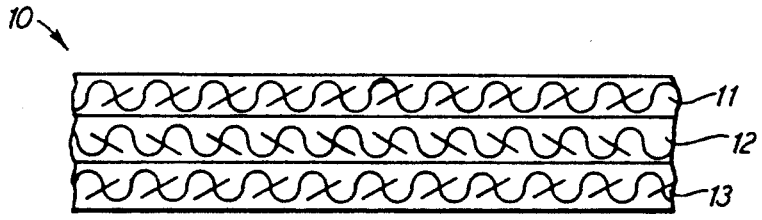
FIG. 1 is a diagrammatical cross-sectional view of a composite nonwoven fabric in accordance with the invention.

FIG. 1 is a diagrammatical cross-sectional view of one embodiment of the invention. The embodiment of FIG. 1, generally indicated at 10, comprises a three ply composite. Ply 11 comprises a hydrophobic nonwoven web, and may be either a web of spunbonded thermoplastic substantially continuous filaments or a web of thermoplastic staple fibers. The thermoplastic polymer used to make ply 11 can be any of various fiber forming polymers used to make hydrophobic fibers and includes polyolefins such as polypropylene and polyethylene, polyesters such as poly(ethylene terephthalate), polyamides such as poly(hexamethylene adipamide) and poly(caproamide), and blends and copolymers of these and other known fiber forming thermoplastic materials. In a preferred embodiment, ply 11 is a spunbonded web of polyolefin filaments as discussed in greater detail later.

Ply 12 comprises a nonwoven fibrous web of thermoplastic meltblown microfibers. The thermoplastic polymer used to form the meltblown layer can be any of various thermoplastic fiber forming materials known to the skilled artisan. Such materials include polyolefins such as polypropylene and polyethylene, polyesters such as poly(ethylene terephthalate), polyamides such as poly(hexamethylene adipamide) and poly(caproamide), polyacrylates such as poly(methylmethacrylate) and poly(ethylmethacrylate), polystyrene, thermoplastic elastomers, and blends of these and other known fiber forming thermoplastic materials. In a preferred embodiment, ply 12 is a nonwoven web of polypropylene meltblown microfibers.

Ply 13 comprises a hydrophilic nonwoven web of staple fibers. The hydrophilic nonwoven web is preferably a carded web comprising a mixture of thermoplastic staple fibers and absorbent staple fibers. The thermoplastic fibers are preferably staple fibers made from any of the various well-known thermoplastics and include polyolefin fibers such as polypropylene and polyethylene fibers, polyester fibers such as poly(ethylene terephthalate) fibers, polyamide fibers such as poly(hexamethylene adipamide) and poly(caproamide) fibers; polyacrylate fibers such as poly(methylmethacrylate) and poly(ethylmethacrylate) fibers; polystyrene fibers, and copolymers and blends of these and other known fiber forming thermoplastic materials. In one embodiment of the invention, the staple fibers employed can be sheath/core or similar bicomponent fibers wherein at least one component of the fiber is polyethylene. The bicomponent fibers can provide improved aesthetics such as hand and softness based on the surface component of the bicomponent fibers, while providing improved strength, tear resistance and the like due to the stronger core component of the fiber. Preferred bicomponent fibers include polyolefin/polyester sheath/core fibers such as a polyethylene/polyethylene terephthalate sheath core fiber.

The absorbent fibers are preferably cotton fibers, wool fibers, rayon fibers, wood fibers, acrylic fibers and the like. The hydrophilic nonwoven web comprises the absorbent fibers in an amount sufficient to impart absorbency characteristics to the web, and advantageously comprises at least about 50% by weight absorbent fibers.

The plies may be bonded and/or laminated to provide discontinuous thermal bonds distributed substantially throughout the composite fabric, i.e., substantially throughout the surface of the composite in any of the ways known in the art. Lamination and/or bonding may be achieved, for example, by the use of an embossing calender, ultrasonic welding and similar means. The pattern of the embossing calender may be any of those known in the art, including spot bonding patterns, helical bonding patterns, and the like. Preferably the spot bonds extend over at least about 6% of the composite fabric surface. The term spot bonding is used herein as being inclusive of continuous or discontinuous pattern bonding, uniform or random point bonding or a combination thereof, all as are well known in the art.

The bonding may be made after assembly of the laminate so as to join all of the plies or it may be used to join only selected of the fabric plies prior to the final assembly of the laminate. Various plies can be bonded by different bonding agents in different bonding patterns. Overall laminate bonding can also be used in conjunction with individual layer bonding. Individual layer bonding may be achieved, for example, by spot bonding, through air bonding or the like.

Figure 2:
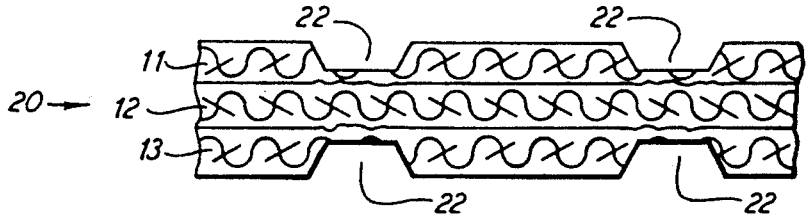
FIG. 2 is a fragmentary cross-sectional view of a composite nonwoven fabric of the invention.
Figure 3:
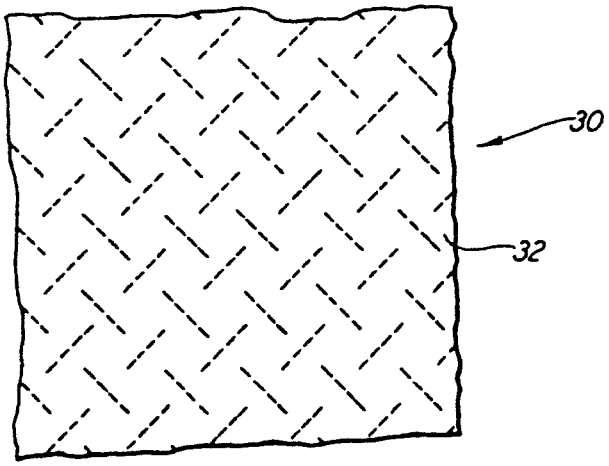
FIG. 3 is a fragmentary plan view of a composite nonwoven fabric of the invention illustrating patterned point bonding.

FIG. 2 is a fragmentary cross-sectional view of a composite nonwoven fabric of the invention, broadly designated as 20. FIG. 2 illustrates one embodiment of the discontinuous thermal bonds of the invention at 22. FIG. 3 is a fragmentary plan view of a composite nonwoven fabric 30 of the invention illustrating one type of bonding of the invention. FIG. 3 illustrates patterned discontinuous point bonding with individual point bonds 32 distributed substantially throughout the fabric 30. Other types of bonding known in the art, such as random discontinuous point bonding, discontinuous pattern bonding with continuous bond lines, continuous pattern bonding with stripes of continuous bonds, and the like, may also be used in the invention.

The composite 10 of FIG. 1 comprises a three ply structure, but there may be three or more similar or dissimilar plies depending upon the particular properties sought for the laminate. The composite may be used in a surgical item, such as, for example, a surgical drape or a surgical gown, or in disposable personal care products, such as, for example, diapers and sanitary napkins.

Figure 4:
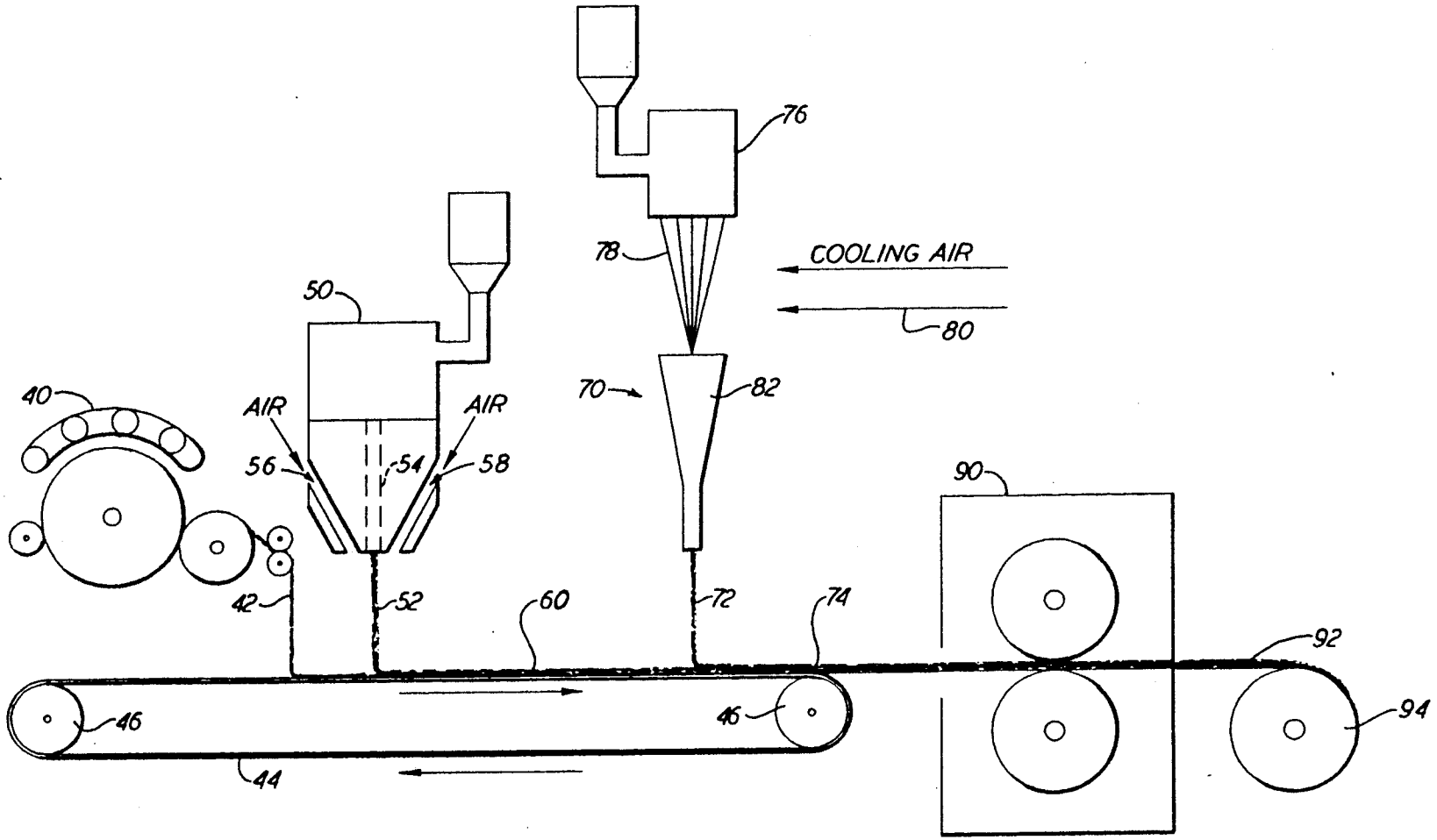
FIG. 4 schematically illustrates one method embodiment of the invention for forming a composite nonwoven fabric of the invention.

FIG. 4 schematically illustrates one method embodiment of the invention for forming a composite nonwoven fabric of the invention. A carding apparatus 40 forms a first carded layer 42 of thermoplastic fibers and absorbent fibers. Web 42 is deposited onto forming screen 44 which is driven in the longitudinal direction by rolls 46.

A conventional meltblowing apparatus 50 forms a meltblown fibrous stream 52 which is deposited onto carded web 42. Meltblowing processes and apparatus are known to the skilled artisan and are disclosed, for example, in U.S. Pat. No. 3,849,241 to Buntin, et al. and U.S. Pat. No. 4,048,364 to Harding, et al. The meltblowing process involves extruding a molten polymeric material through fine capillaries 54 into fine filamentary streams. The filamentary streams exit the meltblowing spinneret face where they encounter converging streams of high velocity heated gas, typically air, supplied from nozzles 56 and 58. The converging streams of high velocity heated gas attenuate the polymer streams and break the attenuated streams into meltblown fibers.

Returning to FIG. 4, the two-layer carded web/meltblown web structure 60 thus formed, is conveyed by forming screen 44 in the longitudinal direction as indicated in FIG. 4. A conventional spunbonding apparatus 70 deposits a spunbonded nonwoven layer 72 onto the two-layer structure 60 to thereby form a composite structure 74 consisting of a carded web/meltblown web/spunbonded web.

The spunbonding process involves extruding a polymer through a generally linear die head or spinneret 76 for melt spinning streams of substantially continuous filaments 78 The spinneret preferably produces the streams of filaments in substantially equally spaced arrays and the die orifices are preferably from about 0.002 to about 0.030 inches in diameter.

As shown in FIG. 4, the substantially continuous filaments 78 are extruded from the spinneret 76 and quenched by a supply of cooling air 80. The filaments are directed to an attenuation zone 82 after they are quenched, and a supply of attenuation air is admitted therein. Although separate quench and attenuation zones are shown in the drawing, it will be apparent to the skilled artisan that the filaments can exit the spinneret 76 directly into an attenuation zone 82 where the filaments can be quenched, either by the supply of attenuation air or by a separate supply of quench air.

The attenuation air may be directed into the attenuation zone 82 by an air supply above the slot, by a vacuum located below a forming wire or by the use of eductors integrally formed in the slot. The air proceeds down the attenuator zone 82, which narrows in width in the direction away from the spinneret 76, creating a venturi effect and causing filament attenuation. The air and filaments exit the attenuation zone 82 and are collected onto the two-layer structure 60 to thereby form a composite structure 74 consisting of a carded web/meltblown web/spunbonded web. Although the spunbonding process has been illustrated by a slot draw apparatus, it will be apparent to the skilled artisan that tube-type spunbonding apparatus and the like can also be used.

Alternatively, a second carding apparatus deposits a second carded web of thermoplastic staple fibers onto the two-layer structure 60 to thereby form a composite structure 74 consisting of a carded web/meltblown web/carded web. The thermoplastic fibers making up the second carded web can be the same or different as the fibers in carded web 42.

The three-layer composite web 74 is conveyed longitudinally as shown in FIG. 4 to a conventional thermal fusion station 90 to provide composite bonded nonwoven fabric 92. The fusion station 90 is constructed in a conventional manner as known to the skilled artisan, and advantageously includes bonding rolls as illustrated in FIG. 4. The bonding rolls may be point bonding rolls, helical bonding rolls, or the like. Because of the wide variety of polymers which can be used in the fabrics of the invention, bonding conditions, including the temperature and pressure of the bonding rolls, vary according to the particular polymer used, and are known in the art for the differing polymers. For example, for polypropylene webs, the calender rolls are heated to a temperature of about 150° C. and are set at a pressure of about 100 pounds per linear inch. The composite is fed through the calender rolls at a speed of about 10 feet per minute to about 1000 feet per minute, and preferably from about 300 feet per minute to about 500 feet per minute.

Although a thermal fusion station in the form of a bonding rolls is illustrated in FIG. 4 and is preferred in the invention, other thermal treating stations such as ultrasonic, microwave or other RF treatment zones which are capable of bonding the fabric can be substituted for the bonding rolls of FIG. 4. Such conventional heating stations are known to those skilled in the art and are capable of effecting substantial thermal fusion of the nonwoven webs via discontinuous thermal bonds distributed substantially throughout the composite nonwoven fabric.

The resultant composite web 92 exits the thermal fusion station 90 and is wound up by conventional means on roll 94.

The method illustrated in FIG. 4 is susceptible to numerous preferred variations. For example, although the schematic illustration of FIG. 4 shows carded webs being formed directly during the in-line process, it will be apparent that the carded webs can be preformed and supplied as rolls of preformed webs. Similarly, although the meltblown web 52 is shown as being formed directly on the carded web 42, and the spunbonded web thereon, meltblown webs and spunbonded webs can be and preferably are preformed onto a forming screen and such preformed web can be passed directly onto a carded web or can be passed through heating rolls for further consolidation and thereafter passed on to a carded web or can be stored in roll form and fed from a preformed roll onto the carded layer 42. Similarly, the three-layer web 74 can be formed and stored prior to thermal bonding at bonding station 90 and the composite nonwoven web 92 can be stored, dried or otherwise treated prior to passage into and through the thermal treatment zone 90.

Although the method illustrated in FIG. 4 employs a meltblown web sandwiched between two carded webs, or between a carded web and a spunbonded web, it will be apparent that different numbers and arrangements of webs can be employed in the invention. Thus, several meltblown layers can be employed in the invention and/or greater numbers of other fibrous webs can be used.

Nonwoven webs other than carded webs are also advantageously employed in the nonwoven fabrics of the invention. Nonwoven staple webs can be formed by air laying, garnetting, and similar processes known in the art. Thus, for example, a composite fabric can be formed according to the invention by forming and thermally treating a spunbonded web/meltblown web/carded web laminate; a carded web/spunbonded web/meltblown web/carded web laminate; a spunbonded web/meltblown web/spunbonded web/carded web laminate; a carded web/spunbonded web/meltblown web/spunbonded web/carded web laminate, or the like.

The invention including the composite fabrics and methods of forming the same, provides a variety of desirable characteristics in a composite nonwoven fabric, including improved barrier properties, fluid repellency, absorption and aesthetic properties.

The following examples serve to illustrate the invention but are not intended to be limitations thereon.

EXAMPLE 1

A composite nonwoven fabric according to the invention is prepared. A nonwoven hydrophobic web is formed by spinbonding polypropylene sold under the Celestra trademark by Fiberweb North America. The resultant spunbonded web of substantially continuous filaments is prebonded by pointbonding and has a basis weight of 1.0 ounce per square yard. A second nonwoven web is prepared by meltblowing polypropylene to give a fibrous web having a basis weight of 20 grams per square meter. A third nonwoven web is formed by carding. The resultant hydrophilic web comprises 50% by weight polypropylene and 50% by weight rayon and has a basis weight of 29 grams per square meter. The hydrophilic nonwoven carded web is also prebonded by pointbonding.

The meltblown web is sandwiched between the hydrophobic and the hydrophilic nonwoven webs and the resultant composite is passed through an oil heated calender fitted with 16% bonding rolls at a rate of 12 ft/minute. The top roll temperature was 288° F. and the bottom roll temperature was 293° F. The roll pressure was 100 pounds per linear inch. Various properties of the fabric were tested, the results of which are summarized in Table 1 below.

TABLE 1

| | | |
|---|---|---|
| Basis Weight | | 2.4 ounces/yd$^2$ |
| Grab Tensile | MD | 36 lbs |
| | CD | 20 lbs |
| Elmendorf Tear | MD | 519 gm |
| | CD | 595 gm |
| Hydrostatic Head | | 26 cm |
| Absorbent Capacity | | 270% |

The resulting fabric provided both high absorption and high water barrier properties in the same fabric. Further, the fabric exhibited good hand and drapeability. Thus the invention provides a fabric having unique capabilities in a single fabric.

The invention has been described in considerable detail with reference to its preferred embodiments. However, it will be apparent that numerous variations and modifications can be made without departure from the spirit and scope of the invention as described in the foregoing detailed specification and defined in the appended claims.

That which is claimed is:

1. A composite nonwoven fabric comprising:

a hydrophobic nonwoven web;

a nonwoven web of thermoplastic meltblown microfibers; and a hydrophilic nonwoven web comprising staple fibers wherein said nonwoven web of thermoplastic meltblown fibers is sandwiched between said hydrophobic nonwoven web and said hydrophilic nonwoven web and wherein all of said layers are thermally bonded together via discontinuous thermal bonds distributed substantially throughout said composite nonwoven fabric.

2. A composite nonwoven fabric according to claim 1 wherein said hydrophobic nonwoven web comprises spunbonded thermoplastic substantially continuous filaments.

3. A composite nonwoven fabric according to claim 1 wherein said hydrophobic nonwoven web comprises thermoplastic staple fibers.

4. A composite nonwoven fabric according to claim 1 wherein said hydrophobic nonwoven web comprises a thermoplastic polymer selected from the group consisting of polyolefins, polyesters, polyamides, and copolymers and blends thereof.

5. A composite nonwoven fabric according to claim 1 wherein said hydrophobic nonwoven web is prebonded.

6. A composite nonwoven fabric according to claim I wherein said thermoplastic meltblown microfibers comprise a thermoplastic polymer selected from the group consisting of polyolefins, polyesters, polyamides, polyacrylates and copolymers and blends thereof.

7. A composite nonwoven fabric according to claim 1 wherein said hydrophilic nonwoven web comprises thermoplastic fibers and absorbent fibers.

8. A composite nonwoven fabric according to claim 1 wherein said hydrophilic nonwoven web is a carded web of thermoplastic fibers and absorbent fibers.

9. A composite nonwoven fabric according to claim 7 wherein said thermoplastic fibers are fibers selected from the group consisting of polyolefin fibers, polyester fibers, polyamide fibers, polyacrylate fibers and copolymers and blends thereof.

10. A composite nonwoven fabric according to claim 7 wherein said absorbent fibers are fibers selected from the group consisting of cotton fibers, wool fibers, rayon fibers, wood fibers, and acrylic fibers.

11. A composite nonwoven web according to claim 1 wherein said hydrophilic nonwoven web is prebonded.

12. A composite nonwoven web comprising:

a hydrophobic nonwoven web comprising hydrophobic thermoplastic spunbonded substantially continuous filaments of a thermoplastic polymer selected from the group consisting of polyolefins, polyesters, polyamides, and copolymers and blends thereof;

a nonwoven web of thermoplastic meltblown microfibers comprising a thermoplastic polymer selected from the group consisting of polyolefins, polyesters, polyamides, polyacrylates and copolymers and blends thereof; and a hydrophilic nonwoven web comprising thermoplastic fibers and absorbent fibers, said thermoplastic fibers are fibers selected from the group consisting of polyolefin fibers, polyester fibers, polyamide fibers, polyacrylate fibers and copolymers and blends thereof, and said absorbent fibers are fibers selected from the group consisting of cotton fibers, wool fibers, rayon fibers, wood fibers, and acrylic fibers, wherein said nonwoven web of thermoplastic meltblown fibers is sandwiched between said hydrophobic nonwoven web and said hydrophilic nonwoven web and wherein all of said layers are thermally bonded together via discontinuous thermal bonds distributed substantially throughout said composite nonwoven fabric.

13. A composite nonwoven fabric comprising:

a hydrophobic polypropylene spunbonded nonwoven web;

a nonwoven web of meltblown polypropylene microfibers; and a hydrophilic carded nonwoven web comprising about 50% by weight polypropylene fibers and about 50% by weight rayon fibers wherein said nonwoven web of thermoplastic meltblown fibers is sandwiched between said hydrophobic nonwoven web and said hydrophilic nonwoven web and wherein all of said layers are thermally bonded together via discontinuous thermal bonds distributed substantially throughout said composite nonwoven fabric.

14. A process for the manufacture of composite nonwoven fabric comprising:

forming a layered web including a nonwoven web of thermoplastic meltblown microfibers sandwiched between a hydrophobic nonwoven web and a hydrophilic nonwoven web comprising staple fibers; and thermally bonding the resultant composite nonwoven fabric so as to provide discontinuous thermal bonds distributed substantially throughout said composite nonwoven fabric.

15. A process according to claim 14 wherein said hydrophobic nonwoven web comprises spunbonded thermoplastic substantially continuous filaments.

16. A process according to claim 14 wherein said hydrophobic nonwoven web comprises thermoplastic staple fibers.

17. A process according to claim 14 wherein said hydrophobic nonwoven web comprises a thermoplastic polymer selected from the group consisting of polyolefins, polyesters, polyamides, and copolymers and blends thereof.

18. A process according to claim 14 wherein said hydrophobic nonwoven web is prebonded.

19. A process according to claim 14 wherein said thermoplastic meltblown microfibers comprise a thermoplastic polymer selected from the group consisting of polyolefins, polyesters, polyamides, polyacrylates and copolymers and blends thereof.

20. A process according to claim 14 wherein said hydrophilic nonwoven web comprises thermoplastic fibers and absorbent fibers.

21. A process according to claim 14 wherein said hydrophilic nonwoven web is a carded web of thermoplastic fibers and absorbent fibers.

22. A process according to claim 20 wherein said thermoplastic fibers are fibers selected from the group consisting of polyolefin fibers, polyester fibers, polyamide fibers, polyacrylate fibers and copolymers and blends thereof.

23. A process according to claim 20 wherein said absorbent fibers are fibers selected from the group consisting of cotton fibers, wool fibers, rayon fibers, wood fibers, and acrylic fibers.

24. A composite nonwoven web according to claim 14 wherein said hydrophilic nonwoven web is prebonded.

25. A process according to claim 14 wherein said forming step comprises:

providing a hydrophobic spunbonded nonwoven web;

providing a nonwoven web of thermoplastic meltblown microfibers;

providing a hydrophilic carded nonwoven web of staple fibers; and layering said hydrophobic nonwoven web, said nonwoven web of thermoplastic meltblown microfibers, and said hydrophilic nonwoven web so that the meltblown nonwoven web is sandwiched between said hydrophobic nonwoven web and said hydrophilic nonwoven web.

26. A process according to claim 14 wherein said bonding step comprises bonding the resultant nonwoven fabric with an embossing calender.

27. A process according to claim 14 wherein said bonding step comprises spot bonding the composite nonwoven fabric.

28. A process according to claim 14 wherein said bonding step comprises helically bonding the composite nonwoven fabric.

29. A process according to claim 14 wherein said bonding step comprises ultrasonically bonding the resultant nonwoven fabric.

30. A process for the manufacture of composite nonwoven fabric comprising:

forming a layered web including a nonwoven web of polypropylene meltblown microfibers sandwiched between a hydrophobic polypropylene spunbonded nonwoven web and a hydrophilic nonwoven web comprising about 50% by weight polypropylene staple fibers and about 50% by weight rayon staple fibers; and thermally bonding the resultant composite nonwoven fabric so as to provide discontinuous thermal bonds distributed substantially throughout said composite nonwoven fabric.

* * * * *

UNITED STATES PATENT AND TRADEMARK OFFICE

CERTIFICATE OF CORRECTION

PATENT NO. : 5,229,191

DATED : July 20, 1993

INVENTOR(S) : Austin

It is certified that error appears in the above-identified patent and that said Letters Patent is hereby corrected as shown below:

Column 2, line 66, after "fibers" and before "The", please insert -- . --.

Column 5, line 67, after "78", please insert -- . --.

Column 8,

In Claim 6, line 61, "Claim I" should be -- Claim 1 --.

Signed and Sealed this

Twenty-fourth Day of May, 1994

Bruce Lehman

BRUCE LEHMAN

*Commissioner of Patents and Trademarks*

*Attest:*

*Attesting Officer*